US005098484A

United States Patent [19]

Eylon et al.

[11] Patent Number: 5,098,484

[45] Date of Patent: Mar. 24, 1992

[54] METHOD FOR PRODUCING VERY FINE MICROSTRUCTURES IN TITANIUM ALUMINIDE ALLOY POWDER COMPACTS

[75] Inventors: Daniel Eylon, Dayton, Ohio; Francis H. Froes, Moscow, Id.; Leslie S. Apgar, Dayton, Ohio

[73] Assignee: The United States of America as represented by the Secretary of the Air Force, Washington, D.C.

[21] Appl. No.: 648,464

[22] Filed: Jan. 30, 1991

[51] Int. Cl.[5] ..... C22C 14/00; C22F 1/00

[52] U.S. Cl. ..... 148/11.5 F; 148/11.5 Q; 148/11.5 P; 148/133

[58] Field of Search ..... 148/11.5 Q, 11.5 P, 148/11.5 F, 133

[56] References Cited

U.S. PATENT DOCUMENTS

| | | | |
|---|---|---|---|
| 4,292,077 | 9/1981 | Blackburn et al. | 75/175.5 |
| 4,518,441 | 5/1985 | Hailey | 148/11.5 P |
| 4,622,079 | 11/1986 | Chang et al. | 148/11.5 F |
| 4,714,587 | 12/1987 | Eylon et al. | 148/11.5 F |
| 4,716,020 | 12/1987 | Blackburn et al. | 420/418 |
| 4,746,374 | 5/1988 | Froes et al. | 148/11.5 F |
| 4,788,035 | 11/1988 | Gigliotti, Jr. et al. | 148/421 |
| 4,808,250 | 2/1989 | Froes et al. | 148/11.5 P |
| 4,851,053 | 7/1989 | Froes et al. | 148/11.5 F |
| 4,919,886 | 4/1990 | Venkataraman et al. | 420/420 |

FOREIGN PATENT DOCUMENTS 1-259139 10/1989 Japan .

OTHER PUBLICATIONS

"Microstructure Control of Titanium Aluminide Powder Compacts by Thermo-Chemical Treatment", L. S. Steele, D. Eylon and F. H. Froes, 1989 Advances in Powder Metallurgy, Metal Powder Industries Federation, Princeton, N.J., published Feb., 1990.

*Primary Examiner*—Upendra Roy

*Attorney, Agent, or Firm*—Charles E. Bricker; Donald J. Singer

[57] ABSTRACT

A method of producing titanium alloy articles having a desired microstructure which comprises the steps of:

(a) providing a prealloyed titanium alloy powder;

(b) filling a suitable die or mold with the powder;

(c) hot isostatic press (HIP) consolidating the powder in the filled mold at a pressure of 30 Ksi or greater and at a temperature of about 60 to 80 percent of the beta transus temperature of the alloy, in degrees C.

In another embodiment of the invention, the prealloyed titanium aluminide alloy powder is hydrogenated to about 0.1 to 1.0 wt. % prior to die filling and consolidation. The compacted article is vacuum annealed to remove hydrogen from the article after removal of the die material.

8 Claims, 1 Drawing Sheet

METHOD FOR PRODUCING VERY FINE MICROSTRUCTURES IN TITANIUM ALUMINIDE ALLOY POWDER COMPACTS

RIGHTS OF THE GOVERNMENT

The invention described herein may be manufactured and used by or for the Government of the United States for all governmental purposes without the payment of any royalty.

BACKGROUND OF THE INVENTION

This invention relates to the processing of titanium alloy articles fabricated by powder metallurgy to improve the microstructure of such articles.

Titanium alloy parts are ideally suited for advanced aerospace systems because of their excellent general corrosion resistance and their unique high specific strength (strength-to-density ratio) at room temperature and at moderately elevated temperatures. Despite these attractive features, the use of titanium alloys in engines and airframes is often limited by cost due, at least in part, to the difficulty associated with forging and machining titanium.

To circumvent the high cost of titanium alloy parts, several methods of making parts to near-net shape have been developed to eliminate or minimize forging and/or machining. These methods include superplastic forming, isothermal forging, diffusion bonding, investment casting and powder metallurgy, each having advantages and disadvantages.

Until relatively recently, the primary motivation for using the powder metallurgy approach for titanium was to reduce cost. In general terms, powder metallurgy involves powder production followed by compaction of the powder to produce a solid article. The small, homogeneous powder particles provide a uniformly fine microstructure in the final product. If the final article is made into a net-shape by the application of processes such as Hot Isostatic Pressing (HIP), a lack of texture can result, thus giving equal properties in all directions. The HIP process has been practiced within a relatively broad temperature range, for example, about 700° to 1200° C. (1300°-2200° F.), depending upon the alloy being treated, and within a relatively broad pressure range, for example, 1 to 30 ksi, generally about 15 ksi.

Recent developments in advanced hypersonic aircraft and propulsion systems require high temperature, low density materials which allow higher strength to weight ratio performance at higher temperatures. As a result, titanium aluminide alloys are now being targeted for many such applications. Titanium aluminide alloys based on the ordered alpha-2 $Ti_3Al$ phase are currently considered to be one of the most promising group of alloys for this purpose. However, because of its ordered structure, the $Ti_3Al$ ordered phase is very brittle at lower temperatures and has low resistance to cracking under cyclic thermal conditions. Consequently, groups of alloys based on the $Ti_3Al$ phase modified with beta stabilizing elements such as Nb, Mo and V have been developed. These elements can impart beta phase into the alpha-2 matrix, which results in improved room temperature ductility and resistance to thermal cycling. However, these benefits are accompanied by decreases in high temperature properties. With regard to the beta stabilizer Nb, it is generally accepted in the art that a maximum of about 11 atomic percent (21 wt %) Nb provides an optimum balance of low and high temperature properties.

Currently, Nb-modified $Ti_3Al$ alloys offer improvements in both hot workability and room temperature ductility as a result of grain refinement, increased slip capabilities in the beta phase, and reduction of the beta-transus temperature. Rapid solidification of these alloys offers the potential for improvement in ductility by grain refinement, by increased alloying possibilities, and by enhanced disordering of the alpha-2 phase. Titanium aluminide alloys can be processed economically utilizing a powder metallurgy (PM) route to produce a near net shape (NNS).

Accordingly, it is an object of the present invention to provide a process for producing articles having a desirable fine microstructure by powder metallurgy of titanium aluminide alloys.

Other objects, aspects and advantages of the present invention will be apparent to those skilled in the art after reading the detailed description of the invention as well as the appended claims.

SUMMARY OF THE INVENTION

In accordance with the present invention there is provided a method for producing titanium alloy articles having a desired microstructure which comprises the steps of:

(a) providing a prealloyed titanium aluminide alloy powder;

(b) filling a suitable die or mold with the powder;

(c) hot isostatic press (HIP) consolidating the powder in the filled mold at a pressure of 30 Ksi or greater and at a temperature of about 60 to 80 percent of the beta transus temperature of the alloy, in degrees C.

In another embodiment of the invention, the prealloyed titanium aluminide alloy powder is hydrogenated to about 0.1 to 1.0 wt % prior to die filling and consolidation. The compacted article is vacuum annealed to remove hydrogen from the article after removal of the die material.

BRIEF DESCRIPTION OF THE DRAWING

In the drawing,

(FIGS. 11 and 15 are 300×; others are 150×).

DETAILED DESCRIPTION OF THE INVENTION

Figure 1:
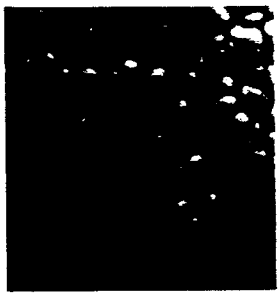
FIGS. 1 and 2 are 1500× photomicrographs illustrating the microstructures of non-hydrogenated and hydrogenated Ti-24Al-11Nb powder, respectively.

The titanium-aluminum alloys suitable for use in the present invention are the alpha-2 alloys containing about 20-30 atomic percent aluminum and about 70-80 atomic percent titanium, and modified with about 1-25 atomic percent of at least one beta stabilizer selected from the group consisting of Nb, Mo and V. The presently preferred beta stabilizer is niobium. As discussed previously, the generally accepted "normal" amount of Nb, for optimum balance of high and low temperature properties, is about 10-11 atomic percent. Examples of titanium-aluminum alloys suitable for use in the present invention include Ti-24Al-11Nb and Ti-25Al-10Nb-3Mo-1V.

For production of high quality, near-net titanium shapes according to the invention, spherical powder free of detrimental foreign particles is desired. In contrast to flake or angular particles, spherical powder flows readily, with minimal bridging tendency, and packs to a consistent density (about 65%).

A variety of techniques may be employed to make the titanium alloy powder, including the rotating electrode process (REP) and variants thereof such as melting by plasma arc (PREP) or laser (LREP) or electron beam, electron beam rotating disc (EBRD), powder under vacuum (PSV), gas atomization (GA) and the like. These techniques typically exhibit cooling rates of about 100° to 100,000° C./sec. The powder typically has a diameter of about 25 to 600 microns.

Production of shapes may be accomplished using a metal can, ceramic mold or fluid die technique. In the metal can technique, a metal can is shaped to the desired configuration by state-of-the-art sheet-metal methods, e.g. brake bending, press forming, spinning, superplastic forming, etc. The most satisfactory container appears to be carbon steel, which reacts minimally with the titanium, forming titanium carbide which then inhibits further reaction. Fairly complex shapes have been produced by this technique.

The ceramic mold shape making process relies basically on the technology developed by the investment casting industry, in that molds are prepared by the lost-wax process. In this process, wax patterns are prepared as shapes intentionally larger than the final configuration. This is necessary since in powder metallurgy a large volume difference occurs in going from the wax pattern (which subsequently becomes the mold) and the consolidated compact. Knowing the configuration aimed for in the compacted shape, allowances can be made using the packing density of the powder to define the required wax-pattern shape.

The fluid die or rapid omnidirectional consolidation (ROC) process is an outgrowth of work on glass containers. In the current process, dies are machined or cast from a range of carbon steels or made from ceramic materials. The dies are of sufficient mass and dimensions to behave as a viscous liquid under pressure at temperature when contained in an outer, more rigid pot die, if necessary. The fluid dies are typically made in two halves, with inserts where necessary to simplify manufacture. The two halves are then joined together to form a hermetic seal. Powder loading, evacuation and consolidation then follow. The fluid die process is claimed to combine the ruggedness and fabricability of metal with the flow characteristics of glass to generate a replicating container capable of producing extremely complex shapes.

In the metal can and ceramic mold processes, the powder-filled mold is supported in a secondary pressing medium contained in a collapsible vessel, e.g., a welded metal can. Following evacuation and elevated-temperature outgassing, the vessel is sealed, then placed in an autoclave or other apparatus capable of isostatically compressing the vessel.

Consolidation of the titanium alloy powder is accomplished by applying a pressure of at least 30 ksi, preferably at least about 35 ksi, at a temperature of about 80 to 90 percent of the beta transus temperature of the alloy (in degrees C.) for about 1 to 48 hours in processes such as HIP, or about 0.25 sec. up to about 300 sec. in processes such as ROC and extrusion. It will be recognized by those skilled in the art that the practical maximum applied pressure is limited by the apparatus employed.

The consolidation temperature can be further reduced by hydrogenating the alloy powder to about 0.2 to 1.0 wt % hydrogen prior to charging the powder to the can, mold or die. The powder can be hydrogenated by placing it in a suitable chamber, charging the chamber with a positive pressure of static pure hydrogen or a mixture of hydrogen and an inert gas such as He or Ar, while heating the chamber to a suitable temperature, e.g., about 1100° F. or about 40% below the beta-transus temperature (in °C.), for a suitable time, then cooling the chamber under pressure to room temperature. Consolidation of the alloy powder is carried out, as above, with the proviso that the consolidation temperature may be about 70 to 80 percent of the beta transus temperature of the alloy (in degrees C.).

Following consolidation, the compacted article is recovered, using techniques known in the art. The resulting article is fully dense and has a very fine, uniform and isotropic microstructure. The compacted article is then annealed, preferably under vacuum, at a temperature about 5 to 40% below the beta-transus temperature (in °C.) of the alloy for about 2 to 48 hours, followed by air or furnace cooling to room temperature.

The following example illustrates the invention.

Prealloyed Ti-24Al-11Nb (at. %) PREP -35 mesh spherical alloy powder, with a median particle size of 170 microns was used. Metallographic samples were prepared at all experimental stages by conventional techniques. Optical microscopy (OM) and scanning electron microscopy (SEM) were utilized in both microstructural and fractographic examination. Differential interference contrast (DIC) was used in examining the microstructure of the as-received powder and the non-hydrogenated specimens. X-ray diffraction (XRD) was conducted on a majority of samples using a diffractometer with $CuK_\alpha$ radiation.

Portions of the alloy powder were hydrogenated as follows: The as-received powder was charged with hydrogen in a vacuum chamber backfilled with a 0.2 atm (3 psi) positive pressure of static pure hydrogen. The chamber was heated to 595° C. (1100° F.) for a period of time, then cooled under pressure to room temperature.

Figure 2:
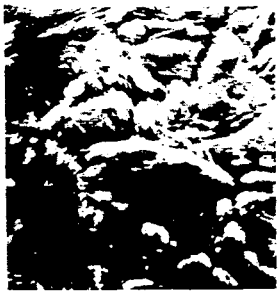

The microstructure of the as-received and the as-hydrogenated powders are compared in the high magnification SEM photomicrographs shown in FIGS. 1 and 2, respectively. The as-received microstructure is a mixture of dendritic and columnar morphologies of beta as indicated by a subsequent XRD scan, not shown. SEM examination of the as-hydrogenated powder (FIG. 2) reveals an additional fine acicular substructure in the dendritic morphology matrix.

Five (5) hydrogenated and three (3) non-hydrogenated powder samples were encapsulated and evacuated at room temperature in low carbon steel cans prior to compaction. HIP compaction was done in an autoclave with a working volume of 100 mm (4 in) diameter by 125 mm (5 in) length at the temperatures shown in Table I, below (hydrogenated specimens are indicated by appending H to the specimen number). In all cases, the HIP conditions consisted of a pressure of 275 MPa (40 ksi) and a time of 4 hours. The average final compact dimensions after can removal were 18 mm (0.7 in) diameter by 88 mm (3.5 in) length. Densification measurements were obtained by OM and SEM examination of metallographically prepared specimens of the compacted material.

TABLE I

| Sample No. | HIP'ing Temperature, Gas Content and Density of as-HIP'd Compacts: HIP'ing Temp. °C./°F. | Compact Hydrogen Content ppm | Compact Oxygen Content wt % | Compact Density % |
|---|---|---|---|---|
| 1 | 815/1500 | 70 | 0.086 | 96-98 |
| 2 | 870/1600 | 170 | 0.088 | 99.8 |
| 3 | 925/1700 | 80 | 0.120 | 100 |
| 4H[a] | 760/1400 | 7000[b] | N/A | 75-80 |
| 5H[a] | 790/1450 | 7000[b] | N/A | 85-90 |
| 6H | 815/1500 | 6708 | 0.096 | 100 |
| 7H | 870/1600 | 5319 | 0.109 | 100 |
| 8H | 925/1700 | 5900 | 0.190 | 100 |

Notes:
a. Unsuccessful compaction; microstructural evaluation was not performed.
b. Based on weight differential measurements before and after hydrogenation.
N/A - data not available.

Figure 3:
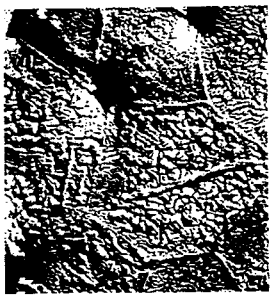
FIGS. 3-8 are 150× photomicrographs illustrating the microstructures of HIP'ed non-hydrogenated and hydrogenated Ti-24Al-11Nb powder compacts.
Figure 4:
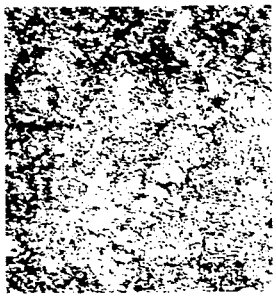
Figure 5:
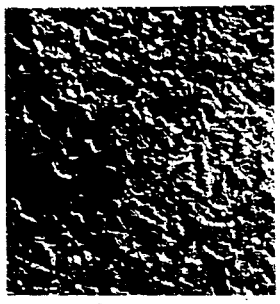
Figure 6:
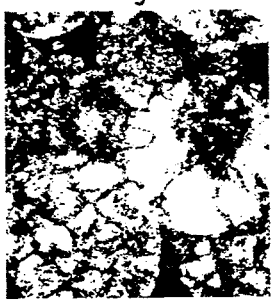
Figure 7:
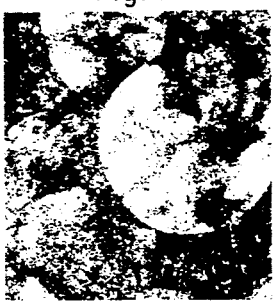
Figure 8:
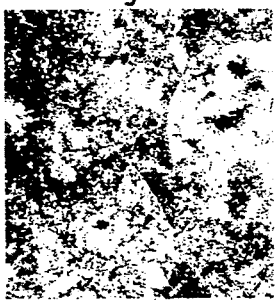
Figure 9:
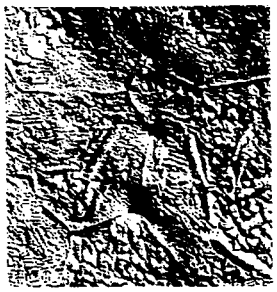
FIGS. 9-16 are photomicrographs of vacuum annealed powder compacts
Figure 10:
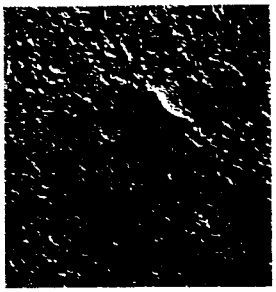
Figure 11:
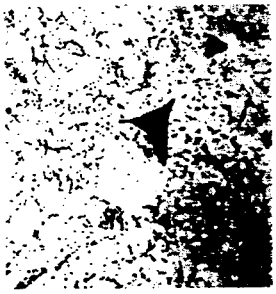
Figure 12:
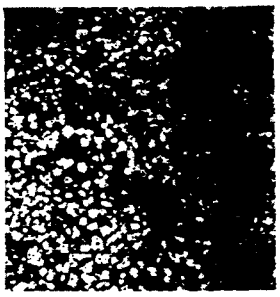
Figure 13:
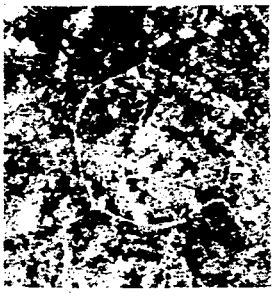
Figure 14:
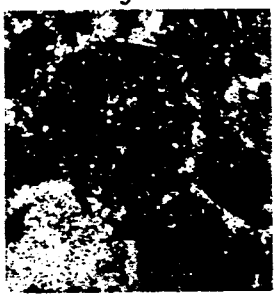
Figure 15:
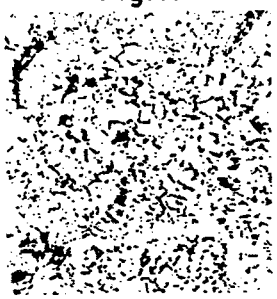
Figure 16:
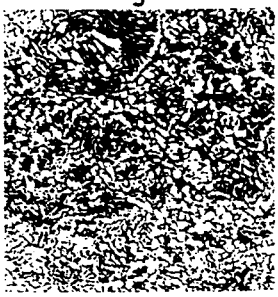

FIGS. 3-8 illustrate the as-HIP'ed microstructures of sample nos. 1-3 and 6H-8H, respectively. Referring to these figures, it can be seen that complete densification of the non-hydrogenated powder was achieved only at 925° C. (FIG. 5). Traces of porosity are present in the non-hydrogenated compacts consolidated at lower temperatures (FIGS. 3 and 4). In contrast, the hydrogenated powder compacts HIP'd at or above 815° C. are fully dense (FIGS. 6-8). Densification results (Table I) indicate that powder hydrogenation reduces the HIP compaction temperature by at least 100° C.

The hydrogenated, as-compacted samples (FIGS. 6-8) exhibit a fine microstructure as compared to the coarse platelet structure of the non-hydrogenated, as-compacted material (FIGS. 3-5). The scale of the microstructural features of the non-hydrogenated material (FIG. 3), HIP'ed at 815° C., is finer in size than the non-hydrogenated material (FIG. 5), HIP'ed at 925° C., and is similar in size to the as-received dendritic morphology of the powder (FIG. 1).

Several small sections from the hydrogenated compacts were dehydrogenated by vacuum annealing at various time/temperature conditions; several small sections from the non-hydrogenated specimens were vacuum annealed together with the hydrogenated material to provide a baseline material with similar thermal cycle history. The dehydrogenation conditions were as follows: 7.5 hours at 650° C. (1200° F.); 6 hours at 700° C. (1400° F.); 4 hours at 870° C. (1600° F.); 3 hours at 915° C. (1800° F.); and 2 hours at 1100° C. (2000° F.). Photomicrographs of sections of samples 2 and 7H are shown in FIGS. 9-16. FIGS. 9-12 illustrate sample no. 2 vacuum annealed at 650° C./7.5 hr, 870° C./4 hr, 915° C./3 hr and 1100° C./2 hr, respectively, and FIGS. 13-16 illustrate sample no. 7H dehydrogenated under the same conditions, respectively.

HIP plus vacuum annealing of the non-hydrogenated compacts developed grain structure (FIGS. 9 and 10) of the same level of refinement as in the original powder particles (FIG. 1) and as in the as-HIP'ed material (FIG. 3). The hydrogenated/dehydrogenated compacts developed an ultrafine grain morphology (FIGS. 13-15) with a wide range of microstructures. Dehydrogenation at 650° C. and 870° C. (FIGS. 13 and 14) retained the ultrafine structures developed during HIP'ing of the hydrogenated powder (FIG. 7). Dehydrogenation at 915° C. and 1100° C. produced coarser microstructures (FIGS. 15 and 16) with lower aspect ratio alpha-two.

Various modifications may be made to the invention as described without departing from the spirit of the invention or the scope of the appended claims.

We claim:

1. A method for producing titanium alloy articles having a desired microstructure which comprises the steps of:

(a) providing prealloyed alpha-2 titanium aluminide powder containing about 20-30 atomic percent aluminum, about 70-80 atomic percent titanium and about 1-25 atomic percent of at least one beta stabilizer selected from the group consisting of Nb, Mo and V;

(b) filling a suitable die or mold with the powder; and (c) consolidating the powder in the filled mold at a pressure of 30 Ksi or greater and at a temperature of about 60 to 80 percent of the beta transus temperature of the alloy, in degrees C.

2. The method of claim 1 further comprising the step of:

(d) annealing the resulting consolidated article to alter its microstructure.

3. The method of claim 1 further comprising the steps of hydrogenating said powder to about 0.1 to 1.0 wt % hydrogen prior to said consolidation step (c) and removing hydrogen from said article following consolidation.

4. The method of claim 1 wherein said beta stabilizer element is Nb.

5. The method of claim 3 wherein said consolidation temperature is about 70 to 80 percent of said beta transus temperature.

6. The method of claim 4 wherein the quantity of Nb is about 10-11 atomic percent.

7. The method of claim 6 wherein said alloy is Ti-24Al-11Nb.

8. The method of claim 6 wherein said alloy is Ti-25Al-10Nb-3Mo-1V.

* * * * *